US011578376B2

(12) United States Patent
Cha et al.

(10) Patent No.: US 11,578,376 B2
(45) Date of Patent: Feb. 14, 2023

(54) STEEL FOR PRESSURE VESSELS HAVING EXCELLENT RESISTANCE TO HYDROGEN INDUCED CRACKING AND MANUFACTURING METHOD THEREOF

(71) Applicant: POSCO, Pohang-si (KR)

(72) Inventors: Woo-Yeol Cha, Pohang-si (KR); Dae-Woo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 178 days.

(21) Appl. No.: 16/472,511

(22) PCT Filed: Dec. 15, 2017

(86) PCT No.: PCT/KR2017/014847
§ 371 (c)(1),
(2) Date: Jun. 21, 2019

(87) PCT Pub. No.: WO2018/117545
PCT Pub. Date: Jun. 28, 2018

(65) Prior Publication Data

US 2020/0095649 A1 Mar. 26, 2020

(30) Foreign Application Priority Data

Dec. 23, 2016 (KR) ..... 10-2016-0178221

(51) Int. Cl.
*C21D 9/46* (2006.01)
*C21D 1/28* (2006.01)
(Continued)

(52) U.S. Cl.
CPC ..... *C21D 9/46* (2013.01); *C21D 1/28* (2013.01); *C21D 6/004* (2013.01); *C21D 6/005* (2013.01);
(Continued)

(58) Field of Classification Search
CPC ..... C22C 38/04; C22C 38/02; C22C 38/44; C21D 8/0205; C21D 8/0226; C21D 9/46; C21D 2211/008; F17C 2203/0639
See application file for complete search history.

(56) References Cited

U.S. PATENT DOCUMENTS

2011/0079328 A1* 4/2011 Yokoi ..... C21C 7/06 148/504
2014/0261906 A1* 9/2014 Hashimura ..... C22C 38/02 148/330
(Continued)

FOREIGN PATENT DOCUMENTS

CN 1688726 A 10/2005
CN 1924066 A 3/2007
(Continued)

OTHER PUBLICATIONS

KR-101253890-B1, Jung Hwan Gyo; Kim Han Kyo; Koh Seong Ung, English translation obtained from EPO, 2013 (Year: 2013).*
(Continued)

*Primary Examiner* — Anthony J Zimmer
*Assistant Examiner* — Jacob J Gusewelle
(74) *Attorney, Agent, or Firm* — Morgan, Lewis & Bockius LLP

(57) ABSTRACT

The present disclosure relates to a steel for pressure vessels used in a hydrogen sulfide atmosphere, and relates to a steel material for pressure vessels having excellent resistance to hydrogen induced cracking (HIC) and a manufacturing method thereof.

11 Claims, 2 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 6/008* (2013.01); *C21D 8/0205* (2013.01); *C21D 8/0226* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/005* (2013.01); *C21D 2211/009* (2013.01)

(56) References Cited

U.S. PATENT DOCUMENTS

| | | | | |
|---|---|---|---|---|
| 2016/0145718 | A1 | | 5/2016 | Furumai et al. |
| 2016/0265078 | A1 | * | 9/2016 | Kajihara ..... C21D 8/0278 |

FOREIGN PATENT DOCUMENTS

| | | | | |
|---|---|---|---|---|
| CN | 102782169 | A | | 11/2012 |
| CN | 103451366 | A | | 12/2013 |
| CN | 105074036 | A | | 11/2015 |
| EP | 1091005 | A3 | | 12/2003 |
| EP | 2520680 | A2 | | 11/2012 |
| EP | 2980235 | A1 | | 2/2016 |
| JP | H08-260092 | A | | 10/1996 |
| JP | H09-227989 | A | | 9/1997 |
| JP | 2003-013175 | A | | 1/2003 |
| JP | 2003-293028 | A | | 10/2003 |
| JP | 2007277642 | A | * | 10/2007 |
| JP | 2014-005534 | A | | 1/2014 |
| JP | 2015-132004 | A | | 7/2015 |
| JP | 2015-178647 | A | | 10/2015 |
| JP | 2015-205338 | A | | 11/2015 |
| KR | 10-2004-0056616 | A | | 7/2004 |
| KR | 10-2005-0092263 | A | | 9/2005 |
| KR | 10-2010-0076727 | A | | 7/2010 |
| KR | 10-2011-0075630 | A | | 7/2011 |
| KR | 10-2012-0044118 | A | | 5/2012 |
| KR | 10-2012-0067150 | A | | 6/2012 |
| KR | 10-1150141 | B1 | | 6/2012 |
| KR | 10-2012-0074638 | A | | 7/2012 |
| KR | 101253890 | B1 | * | 4/2013 |
| KR | 10-2013-0076570 | A | | 7/2013 |
| KR | 10-2016-0075925 | A | | 6/2016 |
| KR | 10-2016-0077385 | A | | 7/2016 |
| WO | 2015/005023 | A1 | | 1/2015 |

OTHER PUBLICATIONS

JP-2007277642-A, Minagawa Masanori; Nakahima Kiyotaka, English Translation obtained from EPO, 2007 (Year: 2007).*

Chinese Office Action dated Jul. 9, 2020 issued in Chinese Patent Application No. 201780079321.7.

International Search Report dated Mar. 29, 2019 issued in International Patent Application No. PCT/KR2017/014847 (with English translation).

Japanese Office Action dated Oct. 6, 2020 issued in Japanese Patent Application No. 2019-533435.

Extended European Search Report dated Oct. 2, 2019 issued in European Patent Application No. 17883354.7.

* cited by examiner

STEEL FOR PRESSURE VESSELS HAVING EXCELLENT RESISTANCE TO HYDROGEN INDUCED CRACKING AND MANUFACTURING METHOD THEREOF

CROSS-REFERENCE OF RELATED APPLICATIONS

This application is the U.S. National Phase under 35 U.S.C. § 371 of International Patent Application No. PCT/KR2017/014847, filed on Dec. 15, 2017, which in turn claims the benefit of Korean Application No. 10-2016-0178221, filed on Dec. 23, 2016, the entire disclosures of which applications are incorporated by reference herein.

TECHNICAL FIELD

The present disclosure relates to a steel for pressure vessels used in a hydrogen sulfide atmosphere, and relates to a steel material for pressure vessels having excellent resistance to hydrogen induced cracking (HIC) and a manufacturing method thereof.

BACKGROUND ART

In recent years, steel for pressure vessels used in petrochemical production facilities, storage tanks, and the like, have been faced with an increase in facility size and steel thickness caused by the increase in operation times, and there is a trend for lowering the carbon equivalent (Ceq) of steel and extremely controlling impurities included in steel so as to guarantee the structural stability of base metals and weld portions when manufacturing large structures.

In addition, due to the increased production of crude oil containing a large amount of $H_2S$, it is more difficult to guarantee quality because of hydrogen induced cracking (HIC).

Particularly, steel used in industrial facilities for mining, processing, transporting, and storing low-quality crude oil are necessarily required to have a property of suppressing the formation of cracks caused by wet hydrogen sulfide contained in crude oil.

In addition, environmental pollution has become a global issue in the case of plant facility accidents, and astronomical costs may be incurred in recovery from such accidents. Therefore, HIC resistance requirements in steel materials have become stricter in the energy industry.

HIC occurs in steel by the following principle.

As the steel sheet comes into contact with the wet hydrogen sulfide contained in crude oil, corrosion occurs, and hydrogen atoms generated by this corrosion penetrate and diffuse into the steel and exist in an atomic state in the steel. Thereafter, the hydrogen atoms are molecularized in a form of hydrogen gas in the steel, thereby generating gas pressure, causing brittle cracks in weak structures (for example, inclusions, segregation zones, internal voids, and the like.) of the steel. When such cracks gradually grow, and if the growth continues to the extent beyond the strength of the steel, fracturing occurs.

Thus, the following techniques have been proposed as methods for improving the HIC resistance of steel used in a hydrogen sulfide atmosphere.

First, a method of adding an element such as copper (Cu) has been proposed. Secondly, there has been proposed a method of significantly reducing or controlling a shape of hard structures (for example, a pearlite phase, or the like) in which cracks easily occur and propagate. Thirdly, there has been proposed a method of improving resistance to crack initiation by changing a processing process to form a hard structure such as tempered martensite, tempered bainite, or the like, as a matrix through a water treatment such as normalizing accelerated cooling tempering (NACT), QT, DOT, or the like. Fourthly, there has been proposed a method of controlling internal defects such as internal inclusions and voids that may act as sites of hydrogen concentration and crack initiation.

The technique of adding copper (Cu) is effective in improving resistance to HIC by forming a stable CuS film on the surface of a material in a weakly acidic atmosphere and thus reducing the penetration of hydrogen into the material. However, it is known that the effect of copper (Cu) addition is not significant in a strongly acidic atmosphere, and moreover, the addition of copper (Cu) may cause high-temperature cracking and surface cracking in steel sheets and may thus increase process costs because of the addition of, for example, a surface polishing process.

The method of significantly reducing the hard structure or controlling the shape is mainly for delaying propagation of cracks by reducing a band index (B.I.) of a band structure occurring on a matrix after normalizing heat treatment.

With regard thereto, Patent Document 1 discloses steel having a tensile strength grade of 500 MPa and high HIC resistance may be obtained by forming a ferrite+pearlite microstructure having a banding index of 0.25 or less by controlling an alloy composition of a slab and processing the slab through a heating process, a hot rolling process, and air cooling process at room temperature, a heating process in a transformation point from Ac1 to Ac3, and then a slow cooling process on the slab.

However, in the case of thin materials having a thickness of 25 mmt or less, an amount of rolling from the slab to a final product thickness is greatly increased, and thus, a Mn-rich layer in the slab present in the slab state is arranged in a form of a strip in a direction parallel to a direction of rolling after a hot rolling process. In addition, although a structure at a normalizing temperature is composed of an austenite single phase, but since the shape and concentration of the Mn-rich layer are not changed, a hard banded structure is reformed during the air cooling process after heat treatment.

The third method is a method of constructing the base phase structure as a hard phase such as acicular ferrite, bainite, martensite, or the like, instead of ferrite+pearlite through a water treatment process such as TMCP, or the like.

With regard thereto, Patent Document 2 discloses that HIC characteristics may be improved by heating a slab controlling an alloy composition, performing finish rolling at 700 to 850° C., then performing accelerated cooling at a temperature of Ar3-30° C. or higher, and finishing accelerated cooling at 350 to 550° C.

Patent Document 2 as described above discloses that an amount of reduction is increased during rolling in a non-recrystallization region, and a general TMCP process is performed to obtain a bainite or acicular ferrite structure through accelerated cooling, and HIC resistance is improved by avoiding a structure vulnerable for propagating cracks such as band structures.

However, when the alloy composition and the control rolling and cooling conditions disclosed in Patent Document 2 are applied, it is difficult to secure proper strength after a post weld heat treatment which is usually applied to steel for pressure vessels. In addition, due to high density potential generated when a low-temperature phase is generated, it may be vulnerable to crack initiation in area region before PWHT is applied or PWHT is not applied, and in particular, HIC characteristics of pipe materials are further deteriorated by raising a work hardening rate generated in the a pipe-making process of the pressure vessels.

Therefore, the conventional methods described above have a limitation in manufacturing a steel material for pressure vessels having hydrogen induced cracking (HIC) characteristics with a tensile strength grade of 550 MPa steel after the PWHT application.

The fourth method is to increase HIC characteristics by increasing cleanliness by significantly reducing inclusions in a slab.

For example, Patent Document 3 discloses that a steel material having high HIC resistance may be manufactured by adjusting a content of calcium (Ca) to satisfy a relationship $0.1 \leq (T.[Ca]-(17/18)\times T.[O]-1.25\times S)/T[O] \leq 0.5)$ when adding calcium (Ca) to molten steel.

The calcium (Ca) may improve HIC resistance to some degree because calcium (Ca) spheroidizes the shape of MnS inclusions that may become the starting points of HIC and forms CaS by reacting with sulfur (S) included in steel. However, if an excessively large amount of calcium (Ca) is added or a ratio of Ca to $Al_2O_3$ is not proper, in particular, if a ratio of CaO is high, HIC resistance characteristics may be deteriorated. Furthermore, in the case of thin materials, coarse oxide inclusions may be fractured according to the composition and shape of the coarse oxide inclusions due to a large accumulated amount of reduction in a rolling process, and at the end, the inclusions may be lengthily scattered in a direction of rolling. In this case, a degree of stress concentration is very high at ends of the scattered inclusions because of partial pressure of hydrogen, and thus HIC resistance characteristics decrease.

To date, in order to improve the hydrogen induced cracking (HIC) performance, as disclosed in Patent Document 3, a Ca treatment technique has been developed such that the content of sulfur in the steel for suppressing the formation of MnS is reduced to an extreme limit of 0.001 wt % and a remaining S does not form MnS during solidification. MnS, sulfide, has a characteristic of elongation in a direction of rolling during a rolling process. Since hydrogen is accumulated in a cutting edge of the starting and ending portions of MnS in which elongation is finished to cause cracking, MnS was changed to CaS so as to suppress the formation, thereby suppressing hydrogen induced cracking by MnS. In the case of CaS, a spherical shape is maintained without being elongated during the rolling process, such that a position in which hydrogen is accumulated is dispersed and a generation of hydrogen induced cracking is suppressed. However, a Ca—Al—O complex oxide including both Ca and Al due to a reaction of $Al_2O_3$ inclusions which necessarily occur during the control of the content of sulfur in the steel to 0.001 wt % or less and CaO generated by oxidation of Ca due to a side effect due to Ca treatment are formed.

Meanwhile, Patent Document 4 discloses that a technique of improving the hydrogen induced cracking performance by controlling the CaO composition in the Ca—Al—O complex oxide. Patent Document 4 discloses a manufacturing method of improving a hydrogen induced cracking characteristic by controlling CaO composition of inclusions.

However, the above-described methods of the related art have the following problems, and it has been difficult to stably manufacture hydrogen induced cracking steel corresponding to a performance required for high strength of a base material.

The most important task is to suppress fracture of the Ca—Al—O complex oxide containing both Ca and Al remaining in the molten steel. As a result of the Ca treatment, a portion of the spherical Ca—Al—O complex oxide manufactured in the molten steel remains in the molten steel, such that a shape of the cast slab remains spherical.

However, when the slab is rolled, the spherical Ca—Al both-containing complex oxide is fractured and becomes an oxide extending to a point, and hydrogen is deposited in the fractured micropores. This causes hydrogen induced cracking in a product. Therefore, it is important to remove as much of the Ca—Al both-containing complex oxide as possible, to control the size of the Ca—Al both-containing complex oxide remaining in the base material to be small and be spheroidized and to suppress fracturing of the Ca—Al both-containing complex oxide, however, it was not sufficiently suppressed in the related art.

Further, an important task is to improve cleanliness of the base material from which the total oxide is removed as much as possible. There was no countermeasure for an effective removing method of the large $Al_2O_3$ oxide before the Ca treatment and a removing method of the Ca—Al both-containing complex oxide remaining in the base material after the Ca treatment. That is, according to the technique in the related art, inclusions were not actively and effectively removed and high degree of cleanliness was not stably obtained.

As described above, although the Ca treatment technique in the related art may suppress the formation of MnS, in response mainly to an increase in yield rate and reduction of S concentration at the time of Ca addition, but it is not possible to suppress fracture of the coarse Ca—Al both-containing complex oxide remaining in the base material, and it was not possible to manufacture hydrogen induced cracking steel having strength as high as that of the related art corresponding to a severe performance evaluation test such as NACE, which is a hydrogen induced cracking acceleration test, having been recently conducted.

Prior Art Document (Patent Document 1) Korean Patent Laid-Open Publication No. 10-2010-0076727

(Patent Document 2) Japanese Patent Laid-Open Publication No. 2003-013175

(Patent Document 3) Japanese Patent Laid-Open Publication No. 2014-005534

(Patent Document 4) Korean Patent Laid-Open Publication No. 10-1150141

DISCLOSURE

Technical Problem

An aspect of the present disclosure is to provide a steel having a strength grade of 550 MPa and excellent resistance to hydrogen induced cracking after post weld heat treatment (PWHT) owing to optimization in alloy composition and manufacturing conditions, and a manufacturing method thereof.

Meanwhile, an aspect of the present disclosure is not limited to the above description. A subject of the present disclosure may be understood from an overall content of the present specification, and it will be understood by those skilled in the art that there is no difficulty in understanding additional subjects of the present disclosure.

Technical Solution

According to an aspect of the present disclosure, a steel for pressure vessels having excellent resistance to hydrogen induced cracking may include, by wt %, carbon (C): 0.06 to 0.25%, silicon (Si): 0.05 to 0.50%, manganese (Mn): 1.0 to 2.0%, aluminum (Al): 0.005 to 0.40%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.05 to 0.15%, copper (Cu): 0.01 to 0.50%, nickel (Ni): 0.05 to 0.50%, calcium (Ca): 0.0005 to 0.0040%, oxygen (O): 0.0010% or less, and a balance of iron (Fe) and inevitable impurities, wherein a microstructure may include 30% or less of pearlite and 70% or more of ferrite by area fraction and may include a Ca—Al—O complex inclusion to satisfy the following Relational Expression 1.

$$S1/S2 \leq 0.1 \qquad \text{Relational Expression 1:}$$

(where S1 is a total area of Ca—Al—O complex inclusions having a size of 6 μm or more measured by a circle equivalent diameter, and S2 is a total area of all Ca—Al—O complex inclusions.)

In addition, according to another aspect of the present disclosure, a manufacturing method of a steel for pressure vessels having excellent resistance to hydrogen induced cracking may include steps of, by wt %: preparing a slab including carbon (C): 0.06 to 0.25%, silicon (Si): 0.05 to 0.50%, manganese (Mn): 1.0 to 2.0%, aluminum (Al): 0.005 to 0.40%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.05 to 0.15%, copper (Cu): 0.01 to 0.50%, nickel (Ni): 0.05 to 0.50%, calcium (Ca): 0.0005 to 0.0040%, oxygen (O): 0.0010% or less, and a balance of iron (Fe) and inevitable impurities; heating the slab to 1150 to 1300° C.; size rolling the heated slab to a temperature in a range of 950 to 1200° C. and then cooling to obtain a bar having a thickness of 80 to 180 mm; heating the bar to 1150 to 1200° C.; finish hot rolling the heated bar to a temperature in a range of (Ar3+30° C.) to (Ar3+300° C.) and then cooling to obtain a hot-rolled steel plate having a thickness of 5 to 65 mm; and performing a normalizing heat treatment step heating the hot-rolled steel plate to 850 to 950° C., maintaining for 10 to 60 minutes, and air cooling to room temperature.

Further, a solution of the above-mentioned problems does not list all of the features of the present disclosure. The various features and advantages and effects of the present disclosure can be understood in more detail with reference to the following specific embodiments.

Advantageous Effects

According to the present disclosure, it is possible to provide a steel suitable as a material for pressure vessels, which not only has excellent resistance to hydrogen induced cracking but also can secure a tensile strength grade of 550 MPa even after PWHT.

BEST MODE FOR INVENTION

Figure 1:
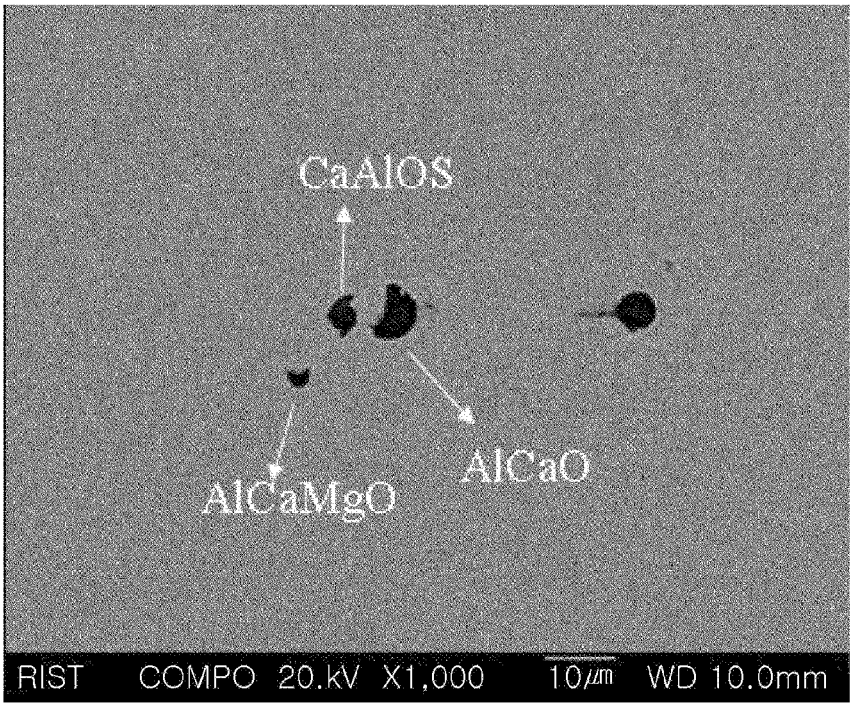
FIG. 1 is a scanning electron image of a Ca—Al—O complex inclusion taken by a scanning electron microscope.

Hereinafter, exemplary embodiments of the present disclosure will be described in detail with reference to the accompanying drawings. The disclosure may, however, be exemplified in many different forms and should not be construed as being limited to the specific embodiments set forth herein, and those skilled in the art and understanding the present disclosure can easily accomplish retrogressive inventions or other embodiments included in the scope of the present disclosure.

The present inventors have conducted intensive research to develop steel having a tensile strength grade of 550 MPa and excellent resistance to hydrogen induced cracking, which can suitably used for purification, transportation, and storage of crude oil, and the like. As a result, it has been found that steel for pressure vessels having excellent HIC characteristics, not decreasing in strength after post weld heat treatment (PWHT) may be provided by precisely controlling a Ca addition process and a cleanliness bubbling process in the manufacturing of the slab to suppress the formation of coarse Ca—Al—O complex inclusions and optimizing the alloy composition and manufacturing conditions. Based on this knowledge, the inventors have invented the present invention.

Steel for Pressure Vessels Having Excellent Resistance to Hydrogen Induced Cracking Hereinafter, steel for pressure vessels having excellent resistance to hydrogen induced cracking according to an aspect of the present disclosure will be described in detail.

A steel for pressure vessels having excellent resistance to hydrogen induced cracking according to an aspect of the present disclosure may include, by wt %, carbon (C): 0.06 to 0.25%, silicon (Si): 0.05 to 0.50%, manganese (Mn): 1.0 to 2.0%, aluminum (Al): 0.005 to 0.40%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.05 to 0.15%, copper (Cu): 0.01 to 0.50%, nickel (Ni): 0.05 to 0.50%, calcium (Ca): 0.0005 to 0.0040%, oxygen (O): 0.0010% or less, and a balance of iron (Fe) and inevitable impurities, wherein a microstructure may include 30% or less of pearlite and 70% or more of ferrite by area fraction and may include a Ca—Al—O complex inclusion to satisfy the following Relational Expression 1.

$$S1/S2 \leq 0.1 \qquad \text{Relational Expression 1:}$$

(where S1 is a total area of Ca—Al—O complex inclusions having a size of 6 μm or more measured by a circle equivalent diameter, and S2 is a total area of all Ca—Al—O complex inclusions.)

First, an alloy composition of the present disclosure will be described in detail. Hereinafter, a unit of each element content may be given in wt % unless otherwise specified.

C: 0.06 to 0.25%

Carbon (C) is a key element for securing the strength of steel, and thus it is preferable that carbon (C) is contained in steel within an appropriate range.

In the present disclosure, desired strength may be obtained when carbon (C) is added in an amount of 0.06% or greater. However, if the content of carbon (C) exceeds 0.25%, center segregation may increase, martensite, a MA phase, or the like may be formed instead of ferrite and pearlite structures after the normalizing heat treatment to result in an excessive increase in strength or hardness. In particular, when the MA phase is formed, HIC characteristics may be worsened.

Therefore, according to the present disclosure, preferably, the content of carbon (C) may be adjusted to within the range of 0.06 to 0.25%, more preferably within the range of 0.10 to 0.20%, and even more preferably within the range of 0.10 to 0.15%.

Si: 0.05 to 0.50%

Silicon (Si) is a substitutional element which improves the strength of steel by solid solution strengthening and has a strong deoxidizing effect, and thus silicon (Si) is required for manufacturing clean steel. To this end, it is preferable to add silicon (Si) in an amount of 0.05% or greater. However, if the content of silicon (Si) is excessively high, the MA phase may be generated, and the strength of a ferrite matrix may be excessively increased, thereby deteriorating HIC characteristics and impact toughness. Thus, it may be preferable to set an upper limit of the content of silicon (Si) to 0.50%.

Therefore, according to the present disclosure, preferably, the content of silicon (Si) may be adjusted to be within the range of 0.05 to 0.50%, more preferably within the range of 0.05 to 0.40%, and even more preferably within the range of 0.20 to 0.35%.

Mn: 1.0 to 2.0%

Manganese (Mn) is an element that improves strength by solid solution strengthening. To this end, it is preferable to add manganese (Mn) in an amount of 1.0% or greater. However, if the content of manganese (Mn) exceeds 2.0%, center segregation increases, and thus manganese (Mn) forms a large amount of fraction of MnS inclusions together with sulfur (S). Therefore, HIC resistance decreases due to the MnS inclusions. In addition, hardenability may be excessively increased, such that a low temperature transformation phase may be generated in a 20 t or less thin material even at a low cooling rate, to deteriorate toughness.

Therefore, according to the present disclosure, the content of manganese (Mn) may be preferably limited to the range of 1.0 to 2.0%, more preferably to the range of 1.0 to 1.7%, and even more preferably to the range of 1.0 to 1.5%.

Al: 0.005 to 0.40%

Aluminum (Al) and silicon (Si) function as strong deoxidizers in a steel making process, and to this end, it may be preferable to add aluminum (Al) in an amount of 0.005% or greater. However, if the content of aluminum (Al) exceeds 0.40%, the fraction of $Al_2O_3$ excessively increases among oxide inclusions generated as a result of deoxidation. Thus, $Al_2O_3$ coarsens, and it becomes difficult to remove $Al_2O_3$ in a refining process. As a result, HIC resistance decreases due to oxide inclusions.

Therefore, according to the present disclosure, preferably, the content of aluminum (Al) may be adjusted to be within the range of 0.005 to 0.40%, more preferably within the range of 0.1 to 0.4%, and even more preferably within the range of 0.1 to 0.35%.

P and S: 0.010% or Less, and 0.0015% or Less, Respectively

Phosphorus (P) and sulfur (S) are elements that induce brittleness in grain boundaries or cause brittleness by forming coarse inclusions. Thus, it may be preferable that the contents of phosphorus (P) and sulfur (S) are limited to 0.010% or less, and 0.0015% or less, respectively, in order to improve resistance to brittle crack propagation of steel.

Lower limits of P and S do not need to be particularly limited, but 0% may be excluded because excessive costs may be required to control it to 0%.

Nb: 0.001 to 0.03%

Niobium (Nb) precipitates in the form of NbC or NbCN and thus improves the strength of a base metal. In addition, niobium (Nb) increases the temperature of recrystallization and thus increases the amount of reduction in non-recrystallization, thereby having the effect of reducing the size of initial austenite grains.

To this end, it may be preferable to add niobium (Nb) in an amount of 0.001% or greater. However, if the content of niobium (Nb) is excessively high, unsolved niobium (Nb) forms TiNb (C,N) which causes UT defects and deterioration of impact toughness and HIC resistance. Therefore, it may be preferable that the content of niobium (Nb) be adjusted to be 0.03% or less.

Therefore, according to the present disclosure, preferably, the content of niobium (Nb) may be adjusted to be within the range of 0.001 to 0.03%, more preferably within the range of 0.005 to 0.02%, and even more preferably within the range of 0.007% to 0.015%.

V: 0.001 to 0.03%

Vanadium (V) is almost completely resolved in a slab reheating process, thereby having a poor precipitation strengthening effect or solid solution strengthening effect in a subsequent rolling process. However, vanadium (V) precipitates as very fine carbonitrides in a heat treatment process such as a PWHT process, thereby improving strength.

To this end, vanadium (V) may be added in an amount of 0.001% or greater. However, if the content of vanadium (V) exceeds 0.03%, the strength and hardness of welded zones are excessively increased, and thus surface cracks may be formed in a pressure vessel machining process. Furthermore, in this case, manufacturing costs may sharply increase, and thus it may not be economical.

Therefore, according to the present disclosure, the content of vanadium (V) may be preferably limited to the range of 0.001 to 0.03%, more preferably to the range of 0.005 to 0.02%, and even more preferably to the range of 0.007 to 0.015%.

Ti: 0.001 to 0.03%

Titanium (Ti) precipitates as TiN during a slab reheating process, thereby suppressing the growth of grains of a base metal and weld heat affected zones and markedly improving low-temperature toughness.

To this end, it may be preferable that the content of titanium (Ti) be 0.001% or greater. However, if the content of titanium (Ti) is greater than 0.03%, a continuous casting nozzle may be clogged, or low-temperature toughness may decrease due to central crystallization. In addition, if titanium (Ti) combines with nitrogen (N) and forms coarse TiN precipitates in a thicknesswise center region, the TiN precipitates may function as starting points of HIC, which is not preferable.

Therefore, according to the present disclosure, the content of titanium (Ti) may be preferably limited to the range of 0.001 to 0.03%, more preferably to the range of 0.010 to 0.025%, and even more preferably to the range of 0.010 to 0.018%.

Cr: 0.01% to 0.20%

Although chromium (Cr) is slightly effective in increasing yield strength and tensile strength by solid solution strengthening, chromium (Cr) has an effect of preventing a decrease in strength by slowing the decomposition of cementite during tempering or PWHT.

To this end, it may be preferable to add chromium (Cr) in an amount of 0.01% or greater. However, if the content of chromium (Cr) exceeds 0.20%, the size and fraction of Cr-rich coarse carbides such as $M_{23}C_6$ are increased to result in a great decrease in impact toughness. In addition, manufacturing costs may increase, and weldability may decrease.

Therefore, according to the present disclosure, it may be preferable that the content of chromium (Cr) be limited to the range of 0.01 to 0.20%.

Mo: 0.05 to 0.15%

Like chromium (Cr), molybdenum (Mo) is an effective element in preventing a decrease in strength during tempering or PWHT and also has an effect in preventing a decrease in toughness caused by grain boundary segregation of impurities such as phosphorus (P). In addition, molybdenum (Mo) increases the strength of a matrix by functioning as a solid solution strengthening element in ferrite.

To this end, it is preferable to add molybdenum (Mo) in an amount of 0.05% or greater. However, if molybdenum (Mo) is added in an excessively large amount, manufacturing costs may increase because molybdenum (Mo) is an expensive element. Thus, it may be preferable to set an upper limit of the content of molybdenum (Mo) to be 0.15%.

Cu: 0.01 to 0.50%

Copper (Cu) is an effective element in the present disclosure because copper (Cu) remarkably improves the strength of a matrix by inducing solid solution strengthening in ferrite and also suppresses corrosion in a wet hydrogen sulfide atmosphere.

To sufficiently obtain the above-mentioned effects, it may be preferable to add copper (Cu) in an amount of 0.01% or greater. However, if the content of copper (Cu) exceeds 0.50%, there is a high possibility that star cracks are formed in the surface of steel, and manufacturing costs may increase because copper (Cu) is an expensive element.

Therefore, according to the present disclosure, it may be preferable to limit the content of copper (Cu) to the range of 0.01 to 0.50%.

Ni: 0.05% to 0.50%

Nickel (Ni) is a key element for increasing strength because nickel (Ni) improves impact toughness and hardenability by increasing stacking faults at low temperatures and thus facilitating cross slip at dislocations.

To this end, nickel (Ni) is preferably added in an amount of 0.05% or greater. However, if the content of nickel (Ni) exceeds 0.50%, hardenability may excessively increase, and manufacturing costs may increase because nickel (Ni) is more expensive than other hardenability-improving elements.

Therefore, according to the present disclosure, the content of nickel (Ni) may be preferably limited to the range of 0.05 to 0.50%, more preferably to the range of 0.10 to 0.40%, and even more preferably to the range of 0.10 to 0.30%.

Ca: 0.0005 to 0.0040%

If calcium (Ca) is added after deoxidation by aluminum (Al), calcium (Ca) combines with sulfur (S) which may form MnS inclusions, and thus suppresses the formation of MnS inclusions. Along with this, calcium (Ca) forms spherical CaS and thus suppresses HIC.

In the present disclosure, it may be preferable to add calcium (Ca) in an amount of 0.0005% or greater so as to sufficiently convert sulfur (S) into CaS. However, if calcium (Ca) is excessively added, calcium (Ca) remaining after forming CaS may combine with oxygen (O) to form coarse oxide inclusions which may be elongated and fractured to cause HIC during a rolling process. Therefore, it may be preferable to set the upper limit of the content of calcium (Ca) to be 0.0040%.

Therefore, according to the present disclosure, it may be preferable that the content of calcium (Ca) be within the range of 0.0005 to 0.0040%.

O: 0.0010% or less

In the present disclosure, the content of sulfur(S) should be suppressed as much as possible in order to suppress the formation of MnS, and the concentration of oxygen (O) dissolved in molten steel is suppressed as much as possible such that a desulfurization process is efficiently performed. Therefore, a total amount of oxygen (O) contained in inclusions almost the same as a total amount of oxygen (O) in a steel material.

In order to secure excellent HIC characteristics, it is preferable to limit not only the size of inclusions but also the total amount of inclusions, such that the content of oxygen (O) is preferably limited to 0.0010% or less.

A balance of the present disclosure is iron (Fe). However, in the ordinary manufacturing process, impurities which are not intended from a raw material or surrounding environments may be inevitably incorporated, such that it may not be excluded. These impurities are not specifically mentioned in this specification, as they are known to any person skilled in the art of the ordinary manufacturing process.

In this case, in addition to the above-described components, nitrogen (N): 20 to 60 ppm by weight may be further included.

Nitrogen (N) has an effect of improving CGHAZ toughness because nitrogen (N) forms precipitates by combining with titanium (Ti) when steel (steel plate) is welded by a single pass high heat input welding method such as electro gas welding (EGW). To this end, it may be preferable that the content of nitrogen (N) be within the range of 20 ppm to 60 ppm by weight.

Hereinafter, the microstructure of the steel according to the present disclosure will be described in detail.

The microstructure of the steel according to the present disclosure includes 30% or less of pearlite and 70% or more ferrite by area fraction. However, this means that values measured excluding the inclusions and precipitates when calculating the area fraction.

If pearlite exceeds 30%, low-temperature impact toughness may be deteriorated, and thus HIC resistance may be also deteriorated due to a pearlite band structure. If the fraction of pearlite is less than 70%, proper strength proposed in the present disclosure may not be secured.

In addition, the Ca—Al—O complex inclusions are included so as to satisfy the following Relational Expression 1.

$$S1/S2 \leq 0.1 \qquad \text{Relational Expression 1:}$$

(where S1 is a total area of Ca—Al—O complex inclusions having a size of 6 μm or more measured at the circle equivalent diameter, and S2 is a total area of all Ca—Al—O complex inclusions.)

When the Relational Expression 1 exceeds 0.1, it means that a large amount of Ca—Al—O complex inclusions having a size of 6 μm or more are present before rolling. In this case, some coarse Ca—Al—O complex inclusions are fractured during rolling and act as a hydrogen adsorption source, resulting in poor resistance to hydrogen induced cracking.

In this case, the Ca—Al—O complex inclusions may not be fractured.

When the Ca—Al—O complex inclusions is fractured, as illustrated in FIG. 1, oxide is elongated to form micro pores, and hydrogen is deposited in the micro pores to cause hydrogen induced cracking.

Even in the case of satisfying the above-described Relational Expression 1, when a finish hot rolling is performed at a temperature of less than Ar3+30° C. as proposed in the present disclosure, the fractured Cr—Al—O complex inclusion may exist and the resistance to hydrogen induced cracking may be deteriorated.

In this case, the steel material of the present disclosure may include (Nb, V) (C, N) precipitates in an amount of 0.01 to 0.02% by area after post weld heat treatment (PWHT), and an average size of the (Nb, V) (C, N) precipitates may be 5 to 30 nm.

Accordingly, the tensile strength after the post weld heat treatment (PWHT) may be secured to 485 MPa or more.

In addition, after the post weld heat treatment (PWHT), CLR may be 10% or less. CLR may more preferably, be 5% or less, and even more preferably, be 1% or less. In this case, CLR, which is a ratio of hydrogen induced cracking length in a length direction of a steel sheet was measured according to relevant international standard NACE TM0284 by immersing, for 96 hours, a specimen in 5% NaCl+0.5% $CH_3COOH$ solution saturated with $H_2S$ gas at 1 atmosphere, measuring the lengths of cracks by an ultrasonic test method, and dividing the total length of the cracks in the length direction of the specimen and the total area of the cracks respectively by the total length of the specimen.

Meanwhile, in the post weld heat treatment, the steel material is heated up to a temperature of 425° C., then heated to a temperature range of 595 to 630° C. at a heating rate of 55 to 100° C./hr and maintained for 60 to 180 minutes, cooled to 425° C. at a cooling rate of 55 to 100° C./hr, and then air cooled to room temperature.

Manufacturing Method of a Steel for Pressure Vessels Having Excellent Resistance to Hydrogen Induced Cracking Hereinafter, a manufacturing method of a steel for pressure vessels having excellent resistance to HIC will be described in detail according to another aspect of the present disclosure.

Briefly, the steel for pressure vessels of the present disclosure having desired properties may be manufactured by preparing a slab having the above-described alloy composition, and performing [size rolling—finish hot rolling—normalizing heat treatment] on the slab.

Slab Preparing Step

A slab satisfying the above-described alloy composition is prepared.

In this case, a step of preparing the slab may include steps of: injecting Metal Ca Wire into molten steel after secondary refining at an addition rate of 100~250 m/min such that an addition amount of Ca is 0.00005~0.00050 kg/ton; and a clean bubbling step of blowing inert gas into the molten steel into which the Metal Ca Wire is added in a blowing amount of 10 to 50 l/min for 5 to 20 minutes.

It is because the contents of Ca and O of the slab are controlled to suppress the formation of MnS and control the total amount of inclusions. In addition, it is also because the Ca—Al—O complex inclusion is controlled so as to satisfy the above-described Relational Expression 1. When a larger number of complex inclusions both containing Ca and Al, or coarsening is performed, inclusions to be fractured during rolling may increase and the hydrogen induced cracking may not be secured.

The step before secondary refining is not particularly limited because it can be performed by a general process. According to the general process, the total amount of inclusions in the molten steel before Ca addition may be 2 to 5 ppm.

(Ca Addition Step)

When an addition rate of Metal Ca Wire is less than 100 m/min, Ca is melted in an upper portion of a ladle and an effect of iron static pressure is reduced, such that a Ca yield ratio is deteriorated and an addition amount thereof is increased. On the other hand, when the addition rate exceeds 250 m/min, Metal Ca Wire contacts to a base of the ladle, and a refractory of the ladle is spoiled and thus stability of the operation may not be secured. Therefore, the addition rate of Metal Ca Wire is preferably 100 to 250 m/min, more preferably 120 to 200 m/min, and even more preferably 140 to 180 m/min.

When the amount of Ca addition is less than 0.00005 kg/ton, MnS is generated at a center portion during solidification and resistance to hydrogen induced cracking may be deteriorated. When the amount of Ca addition exceeds 0.00005 kg/ton, it reacts with $Al_2O_3$ components of the refractory and spoil of the refractory is accelerated such that it is difficult to secure productivity and the stability of operation may not be secured. Therefore, the amount of Ca addition may preferably be 0.00005 to 0.00050 kg/ton, more preferably 0.00010 to 0.00040 kg/ton, even more preferably 0.00015 to 0.00030 kg/ton.

In this case, the Metal Ca Wire is composed of a Ca alloy and a steel material surrounding a Ca alloy, and the thickness of the steel material may be 1.2 to 1.4 mm.

When the thickness of the steel material is less than 1.2 mm, since Ca is melted in an upper portion of the ladle and the effect of the iron static pressure is reduced, such that the Ca yield ratio may be deteriorated and the amount of Ca addition may be increased. On the other hand, when the thickness of the steel material excesses 1.4 mm, Metal Ca Wire contacts to the base of the ladle and the refractory of the ladle is spoiled, such that the stability of the operation may not be secured.

(Clean Bubbling Step)

When a blowing amount is less than 10/min, an amount of $Al_2O_3$ Cluster adhered to the inert gas to be removed and the complex inclusion containing both Ca and Al are decreased, resulting in deteriorating the degree of cleanliness, such that the hydrogen induced cracking property may not be secured. When a blowing amount excesses 50 l/min, an agitating force is strengthened, and slag inclusion occurs at the same time as the surface of molten steel is disturbed, resulting in deteriorating the degree of cleanliness, such that the hydrogen induced cracking property may not be secured. Therefore, the blowing amount of the inert gas is preferably 10 to 50 l/min, more preferably 15 to 40 l/min, and even more preferably 20 to 30 l/min.

When a blowing time is less than 5 minutes, an amount of $Al_2O_3$ Cluster adhered to the inert gas to be removed and the complex inclusions containing both Ca and Al are decreased, resulting in deteriorating the degree of cleanliness, such that the hydrogen induced cracking property may not be secured. When a blowing time exceeds 20 minutes, a temperature drop in the molten steel becomes large and temperature gradient in the ladle is generated, and the degree of cleanliness is deteriorated, such that the hydrogen induced cracking property may also not be secured. Therefore, the blowing time may be preferably 5 to 20 minutes, more preferably be 7 to 17 minutes, and even more preferably, be 10 to 14 minutes.

In this case, blowing the inert gas may be performed through the inert gas blowing point in the ladle, and the inert gas blowing point may be two.

When the gas blowing point is one, there is a non-uniform region in the molten steel, a removing ability of $Al_2O_3$ Cluster and the complex inclusions containing both Ca and Al may be deteriorated, and when the gas blowing point is 3 or more, overlapping portions are generated at the time of gas blowing, and an agitating force is strengthened, such that slag inclusion occurs at the same time as the surface of molten steel is disturbed and the degree of cleanliness may be deteriorated.

Meanwhile, the slab manufactured through the control of the Ca addition step and the clean bubbling step, as described above, may include the Ca—Al—O complex inclusion so as to satisfy the following Relational Expression 1.

$$S1/S2 \leq 0.1 \quad \text{Relational Expression 1:}$$

(where S1 is the total area of Ca—Al—O complex inclusions having a size of 6 μm or more measured at the circle equivalent diameter, and S2 is a total area of all Ca—Al—O complex inclusions.)

Slab Heating Step

The slab is heated to 1150 to 1300° C.

The reason for heating the slab to a temperature of 1150° C. or greater for resolving Ti or Nb carbonitrides or coarsely crystallized TiNb (C,N), which are formed during a casting process. In addition, the reason is for heating is for homogenizing a structure and securing a size rolling end temperature to be sufficiently high, thereby significantly reducing crushing inclusions by heating austenite to a temperature equal to or higher than an austenite recrystallization temperature and maintaining the austenite before size rolling.

However, if the slab is heated to an excessive high temperature, problems may occur due to oxide scale formed at high temperatures, and manufacturing costs may excessively increase for heating and maintaining. Thus, it may be preferable that an upper limit of the slab heating temperature is 1300° C.

Size Rolling Step

The heated slab is subject to size rolling to a temperature in a range of 950 to 1200° C. and then cooled to obtain a bar having a thickness of 80 to 180 mm. The size rolling weakens the formation of band structure due to an increase of reduction ratio in the finish hot rolling and significantly reduces inclusion crushing by reducing the total reduction ratio in the finish hot rolling step.

In the case of hot rolling without performing size rolling, oxide inclusions may be fractured due to cumulative reduction ratio in the non-crystallization region and may function as crack initiation points, such that a rolling end temperature of size rolling may preferably be 950° C. or greater. However, it is preferable that the temperature of size rolling is 950° C. to 1200° C. in consideration of a cooling rate in the air and a passing rate between rolling in the step of obtaining the bar having the target thickness of 80 to 180 mm.

When the thickness of bar after finishing size rolling exceeds 180 mm, the thickness ratio of the final steel plate to the thickness ratio of the bar during finish rolling increases, such that the rolling reduction ratio is increased, and the possibility of finish rolling in the non-crystallization region is increased. When the non-recrystallization reduction ratio is increased, the hydrogen induced cracking property may be deteriorated by the fracture of the oxide inclusion in austenite before normalizing. Therefore, the thickness of bar after the size rolling may preferably be 80 to 180 mm, more preferably be 100 to 160 mm, and even more preferably be 120 to 140 mm.

In this case, the grain size of austenite of the bar after the size rolling may be 100 μm or more, may preferably be 150 μm or more, and even more preferably be 150 μm or more, and may be appropriately adjusted by the desired strength and HIC characteristics.

Bar Heating Step

The bar is heated to 1100 to 1200° C.

The reason for heating at a temperature of 1100° C. or higher is to allow rolling to proceed at a temperature, higher than the recrystallization temperature during finish rolling.

However, when the heating temperature is excessively high, a growth rate of precipitates as TiN manufactured at a high temperature may be accelerated, such that the reheating temperature is preferably 1200° C. or lower.

Finish Hot Rolling Step

The heated bar is subjected to finish hot rolling to a temperature in a range of (Ar3+30° C.) to (Ar3+300° C.) and then cooled to obtain a hot-rolled steel plate having a thickness of 5 to 65 mm. The reason is to prevent fracturing of inclusions of and perform finish hot rolling at a temperature at which grain refinement due to recrystallization occurs at the same time.

When the temperature of finish hot rolling is less than Ar3+30° C., coarse complex inclusions are fractured or MnS inclusions are elongated to directly cause occurrence and propagation of hydrogen induced cracking. Therefore, the finish hot rolling may preferably be terminated at a temperature of AR3+30° C. or higher, more preferably be AR3+50° C., and even more preferably be AR3+60° C.

On the other hand, when the temperature exceeds Ar3+300° C., austenite grains may be excessively coarsened, such that the strength and impact toughness may be deteriorated.

In this case, when an amount dissolved hydrogen in the molten steel is 1.3 ppm or more in a steelmaking process, it may be cooled by multi-stage loading until it is cooled to room temperature at a temperature of 200° C. or higher after the finish hot rolling before the normalizing heat treatment.

As described above, when the multi-stage loading cooling is performed, internal microcracking due to hydrogen may be further effectively suppressed by releasing hydrogen dissolved in the steel, and finally the hydrogen induced cracking property may be improved.

Normalizing Heat Treatment Step

The hot-rolled steel plate is heated to 850 to 950° C., maintained for 10 to 60 minutes, and then subjected to a normalizing heat treatment.

When the temperature is less than 850° C. or a maintaining time is less than 10 minutes, carbides generated in the cooling after rolling or impurities segregated in the grain boundaries are not smoothly resolved such that the low-temperature toughness may be significantly lowered. On the other hand, when the temperature exceeds 950° C. or the maintaining time exceeds 60 minutes, toughness may be degraded due to coarsening of austenite and coarsening of precipitation phases such as Nb(C,N), V(C,N), and the like.

MODE FOR INVENTION

Hereinafter, the present disclosure will be described more specifically with reference to detailed exemplary embodiments. The following exemplary embodiments are merely examples for easier understanding of the present disclosure, and the scope of the present disclosure is not limited thereto.

Embodiment

A slab having a thickness of 300 mm and the composition shown in Table 1 below were prepared by using a slab preparing process shown in Table 2 below. In this case, the thickness of a steel shell covering a Ca alloy of Metal Ca wire was set to be 1.3 mm, and an inert gas lowing point in a ladle in a clean bubbling process was fixed to two.

The slab was subjected to a hot-rolled steel plate manufacturing process shown in Table 2 below to obtain a hot-rolled steel plate having a thickness of 65 mm, and then multi-stage loading was performed using a heat insulating cover at a temperature of 200° C. or greater for hydrogen release remaining in the product during cooling. Thereafter, heat treatment was performed at 890° C. according to a normalizing time shown in Table 2 below to obtain a final steel.

Ar3 was obtained by a value calculated by the Relational Expression below.

$$Ar3=910-310C-80Mn-20Cu-15Cr-55Ni-80Mo+0.35\,(\text{Plate Thickness}-8)$$

The microstructure and Ca—Al—O inclusions of the steel were observed and shown in Table 3 below.

Microstructure fractions in each of the steel plates were measured using an image analyzer after capturing images at magnifications of 100 times and 200 times using an optical microscope.

The Ca—Al—O complex inclusion was subjected to a compositional analysis by EDS. The total area of inclusions containing both Ca and Al at the same time, having a size of 6 μm or greater measured by circle equivalent diameter was S1, and the total area of all complex inclusions was S2.

In addition, whether the fractured Ca—Al—O inclusions are observed was indicated.

In addition, changes in tensile strength before and after PWHT were measured, and precipitates after PWHT were observed and described in Table 3 below. In this case, in order to simulate the PWHT process, the steel was heated up to 425° C., then heated from the temperature to 610° C. at a heating rate of 80° C./hr, maintained at that temperature for 100 minutes, then cooled to 425° C. at the same rate as the heating rate and then air-cooled to room temperature.

In the case of carbonitride, the fraction and size of Nb (C, N) precipitates were measured by Carbon Extraction Replica and Transmission Electron Microscopy (TEM), and in the case of V(C, N), a crystal structure of the precipitates was confirmed by TEM diffraction analysis, and the fractions and sizes of (Nb, V) (C, N) precipitates were calculated by measuring the fractions and sizes of (Nb, V) (C, N) precipitates with Atom Probe Tomography (APM).

Meanwhile, HIC evaluation was performed for the steel after PWHT, and Crack Length Ratio (CLR) and Crack Thickness Ratio (CTR) were measured.

The crack length ratio (CLR, %) being a hydrogen induced crack length ratio in the length direction of a steel plate was used as an HIC resistance index and measured according to relevant international standard NACE TM0284 by immersing, for 96 hours, a specimen in 5% NaCl+0.5% $CH_3COOH$ solution saturated with $H_2S$ gas at 1 atmosphere, measuring the lengths and areas of cracks by an ultrasonic test method, and dividing the total length of the cracks in the length direction of the specimen and the total area of the cracks respectively by the total length and total area of the specimen.

The CTR is measured by measuring the thickness instead of the length under the same conditions.

TABLE 1

| | Alloy composition (A unit of P*, S*, Ca*, and O* is ppm by weight, and a unit of remaining elements is % by weight) | | | | | | | | | | | | | | |
|---|---|---|---|---|---|---|---|---|---|---|---|---|---|---|---|
| No. | C | Si | Mn | Al | P* | S* | Nb | V | Ti | Cr | Mo | Cu | Ni | Ca* | O* |
| IE1 | 0.18 | 0.35 | 1.13 | 0.035 | 80 | 8 | 0.007 | 0.015 | 0.015 | 0.08 | 0.05 | 0.45 | 0.10 | 35 | 9.1 |
| IE2 | 0.17 | 0.31 | 1.12 | 0.031 | 70 | 6 | 0.010 | 0.016 | 0.016 | 0.04 | 0.05 | 0.11 | 0.25 | 27 | 7.8 |
| IE3 | 0.18 | 0.32 | 1.21 | 0.032 | 51 | 5 | 0.021 | 0.019 | 0.015 | 0.10 | 0.07 | 0.35 | 0.15 | 21 | 6.5 |
| IE4 | 0.19 | 0.35 | 1.09 | 0.033 | 83 | 5 | 0.015 | 0.027 | 0.022 | 0.15 | 0.08 | 0.04 | 0.07 | 23 | 7.3 |
| IE5 | 0.17 | 0.36 | 1.1 | 0.035 | 75 | 5 | 0.017 | 0.012 | 0.005 | 0.09 | 0.08 | 0.20 | 0.12 | 16 | 6.1 |
| IE6 | 0.2 | 0.33 | 1.17 | 0.036 | 81 | 4 | 0.005 | 0.016 | 0.027 | 0.03 | 0.11 | 0.25 | 0.08 | 30 | 8.2 |
| CE1 | 0.29 | 0.35 | 1.15 | 0.031 | 81 | 9 | 0.007 | 0.007 | 0.013 | 0.1 | 0.12 | 0.35 | 0.35 | 22 | 7.5 |
| CE2 | 0.16 | 0.33 | 2.15 | 0.032 | 80 | 6 | 0.015 | 0.015 | 0.01 | 0.01 | 0.06 | 0.05 | 0.15 | 22 | 6.3 |
| CE3 | 0.18 | 0.37 | 1.12 | 0.031 | 71 | 22 | 0.001 | 0.013 | 0.011 | 0.02 | 0.07 | 0.1 | 0.13 | 32 | 6.9 |
| CE4 | 0.15 | 0.35 | 1.10 | 0.035 | 83 | 8 | 0.0005 | 0.0007 | 0.007 | 0.01 | 0.06 | 0.11 | 0.19 | 34 | 7.9 |
| CE5 | 0.18 | 0.31 | 1.15 | 0.031 | 70 | 8 | 0.006 | 0.001 | 0.001 | 0.01 | 0.05 | 0.01 | 0.1 | 3 | 7.9 |
| CE6 | 0.17 | 0.33 | 1.16 | 0.035 | 71 | 9 | 0.001 | 0.001 | 0.013 | 0.07 | 0.06 | 0.09 | 0.12 | 4 | 6.5 |
| CE7 | 0.16 | 0.3 | 1.15 | 0.035 | 73 | 10 | 0.005 | 0.007 | 0.001 | 0.08 | 0.05 | 0.01 | 0.1 | 24 | 13.5 |
| CE8 | 0.18 | 0.35 | 1.1 | 0.031 | 72 | 8 | 0.001 | 0.012 | 0.012 | 0.05 | 0.05 | 0.05 | 0.13 | 26 | 17.2 |
| CE9 | 0.19 | 0.36 | 1.23 | 0.036 | 81 | 7 | 0.004 | 0.019 | 0.001 | 0.08 | 0.06 | 0.05 | 0.15 | 4 | 8.9 |
| CE10 | 0.2 | 0.38 | 1.31 | 0.031 | 62 | 6 | 0.001 | 0.015 | 0.013 | 0.01 | 0.06 | 0.01 | 0.17 | 2 | 8.2 |
| CE11 | 0.15 | 0.39 | 1.15 | 0.037 | 83 | 8 | 0.006 | 0.012 | 0.015 | 0.05 | 0.06 | 0.01 | 0.15 | 26 | 23.5 |
| CE12 | 0.16 | 0.35 | 1.1 | 0.03 | 63 | 6 | 0.001 | 0.007 | 0.012 | 0.03 | 0.07 | 0.01 | 0.18 | 29 | 20.7 |
| CE13 | 0.18 | 0.3 | 1.12 | 0.038 | 88 | 7 | 0.015 | 0.006 | 0.001 | 0.06 | 0.07 | 0.03 | 0.25 | 21 | 7.5 |
| CE14 | 0.17 | 0.31 | 1.25 | 0.039 | 75 | 10 | 0.001 | 0.007 | 0.016 | 0.07 | 0.08 | 0.15 | 0.23 | 26 | 5.9 |
| CE15 | 0.18 | 0.35 | 1.27 | 0.035 | 70 | 9 | 0.017 | 0.015 | 0.003 | 0.01 | 0.05 | 0.05 | 0.12 | 24 | 7.1 |
| CE16 | 0.2 | 0.33 | 1.1 | 0.031 | 65 | 10 | 0.001 | 0.019 | 0.011 | 0.05 | 0.05 | 0.07 | 0.1 | 32 | 6.3 |
| CE17 | 0.17 | 0.34 | 1.18 | 0.035 | 60 | 6 | 0.007 | 0.008 | 0.005 | 0.01 | 0.06 | 0.05 | 0.13 | 39 | 6.9 |
| CE18 | 0.16 | 0.35 | 1.19 | 0.036 | 59 | 4 | 0.013 | 0.015 | 0.005 | 0.01 | 0.08 | 0.07 | 0.1 | 18 | 7.5 |

*IE: Inventive Example

** CE: Comparative Example

TABLE 2

| | Slab manufacturing process | | | | Hot-rolled steel pate manufacturing process | | | |
|---|---|---|---|---|---|---|---|---|
| | | | Blowing | | | | | |
| No. | Amount of Ca addition (kg/ton) | Addition rate (m/min) | amount of bubbling gas (l/min) | Bubbling time (min) | Temperature of size rolling (° C.) | Thickness of Bar (mm) | Temperature of finish hot rolling-Ar3 (° C.) | Normalizing time (min) |
| IE1 | 0.00042 | 115 | 16 | 7 | 1100 | 130 | 69 | 12 |
| IE2 | 0.00030 | 150 | 30 | 9 | 1112 | 141 | 102 | 11 |
| IE3 | 0.00025 | 130 | 29 | 15 | 1128 | 151 | 63 | 20 |
| IE4 | 0.00028 | 120 | 25 | 14 | 1115 | 144 | 68 | 25 |
| IE5 | 0.00012 | 150 | 40 | 18 | 1100 | 138 | 73 | 30 |
| IE6 | 0.00034 | 160 | 32 | 10 | 1091 | 139 | 82 | 18 |
| CE1 | 0.00026 | 130 | 28 | 12 | 1142 | 142 | 91 | 17 |
| CE2 | 0.00023 | 130 | 26 | 15 | 1115 | 140 | 66 | 16 |
| CE3 | 0.00031 | 145 | 34 | 12 | 1117 | 133 | 53 | 11 |
| CE4 | 0.00029 | 135 | 37 | 9 | 1132 | 131 | 80 | 10 |
| CE5 | 0.00003 | 120 | 30 | 12 | 1105 | 127 | 91 | 11 |
| CE6 | 0.00004 | 130 | 30 | 13 | 1102 | 151 | 90 | 20 |
| CE7 | 0.00029 | 135 | 8 | 10 | 1115 | 139 | 88 | 21 |
| CE8 | 0.00028 | 140 | 70 | 11 | 1120 | 141 | 81 | 18 |
| CE9 | 0.00035 | 52 | 35 | 8 | 1151 | 137 | 83 | 12 |
| CE10 | 0.00019 | 30 | 28 | 13 | 1122 | 135 | 85 | 19 |
| CE11 | 0.00022 | 140 | 27 | 2 | 1125 | 142 | 100 | 21 |
| CE12 | 0.00032 | 155 | 22 | 3 | 1175 | 142 | 91 | 22 |
| CE13 | 0.00019 | 135 | 12 | 10 | 1270 | 201 | −35 | 30 |
| CE14 | 0.00030 | 130 | 32 | 16 | 1290 | 193 | −47 | 31 |
| CE15 | 0.00022 | 115 | 26 | 11 | 1131 | 137 | 12 | 40 |
| CE16 | 0.00038 | 125 | 19 | 15 | 1085 | 133 | 17 | 19 |
| CE17 | 0.00045 | 155 | 45 | 12 | 993 | 108 | 93 | 181 |
| CE18 | 0.00016 | 140 | 35 | 10 | 1073 | 115 | 86 | 99 |

* IE: Inventive Example
** CE: Comparative Example

TABLE 3

| | Micro structure (by area %) | | (Nb, V)(C, N) precipitates | | Ca—Al—O complex inclusion | | | | Tensile strength (MPa) | | HIC(%) | |
|---|---|---|---|---|---|---|---|---|---|---|---|---|
| No. | Pearlite | Ferrite | Fraction (by area %) | size (μm) | S1 ($\mu m^2$) | S2 ($\mu m^2$) | S1/S2 | Fraction or not | Before PWHT | After PWHT | CLR | CTR |
| IE1 | 18 | 82 | 0.011 | 38 | 623 | 7216 | 0.09 | X | 512.0 | 504.1 | 0 | 0 |
| IE2 | 17 | 83 | 0.015 | 37 | 486 | 6100 | 0.08 | X | 498.6 | 490.7 | 0.1 | 0 |
| IE3 | 18 | 82 | 0.013 | 33 | 215 | 5335 | 0.04 | X | 520.9 | 513.1 | 0 | 0 |
| IE4 | 19 | 81 | 0.011 | 38 | 184 | 6530 | 0.03 | X | 528.4 | 520.5 | 0 | 0 |
| IE5 | 18 | 82 | 0.013 | 39 | 116 | 4846 | 0.02 | X | 528.3 | 520.5 | 0 | 0 |
| IE6 | 20 | 80 | 0.012 | 41 | 480 | 5935 | 0.08 | X | 570.7 | 562.9 | 0 | 0 |
| CE1 | 31 | 69 | 0.015 | 50 | 352 | 5435 | 0.06 | X | 625.3 | 599.4 | 13 | 3.3 |
| CE2 | 16 | 84 | 0.012 | 41 | 232 | 4538 | 0.05 | X | 596.6 | 588.8 | 37 | 17 |
| CE3 | 18 | 82 | 0.017 | 35 | 335 | 5568 | 0.06 | X | 533.5 | 525.6 | 49 | 13 |
| CE4 | 14 | 86 | 0.0002 | 9 | 498 | 6240 | 0.08 | X | 490.2 | 482.4 | 0.1 | 0 |
| CE5 | 17 | 83 | 0.012 | 32 | 290 | 6350 | 0.05 | X | 504.9 | 497.1 | 39 | 8.8 |
| CE6 | 17 | 83 | 0.012 | 29 | 220 | 6280 | 0.04 | X | 509.8 | 501.9 | 45 | 5.5 |
| CE7 | 16 | 84 | 0.015 | 23 | 2684 | 12573 | 0.12 | ○ | 498.5 | 490.7 | 37 | 7.3 |
| CE8 | 18 | 82 | 0.018 | 25 | 3953 | 15876 | 0.29 | ○ | 522.8 | 514.9 | 29 | 6.3 |
| CE9 | 18 | 82 | 0.017 | 27 | 658 | 7315 | 0.09 | X | 549.4 | 541.6 | 21 | 8.4 |
| CE10 | 19 | 81 | 0.015 | 19 | 345 | 6912 | 0.05 | X | 558.7 | 550.9 | 29 | 8.4 |
| CE11 | 16 | 84 | 0.016 | 10 | 7685 | 24056 | 0.17 | ○ | 511.2 | 503.3 | 22 | 7.9 |
| CE12 | 17 | 83 | 0.017 | 12 | 8045 | 22540 | 0.39 | ○ | 505.0 | 497.2 | 19 | 5.5 |
| CE13 | 18 | 82 | 0.018 | 19 | 483 | 5903 | 0.08 | ○ | 520.4 | 512.6 | 13 | 8.3 |
| CE14 | 17 | 83 | 0.016 | 25 | 108 | 4631 | 0.02 | ○ | 533.4 | 525.6 | 12 | 5.9 |
| CE15 | 19 | 81 | 0.015 | 23 | 511 | 6211 | 0.08 | ○ | 542.0 | 534.2 | 25 | 10.7 |
| CE16 | 21 | 89 | 0.011 | 31 | 268 | 4351 | 0.06 | ○ | 545.4 | 537.6 | 29 | 13 |
| CE17 | 17 | 83 | 0.029 | 213 | 255 | 4985 | 0.05 | X | 558.8 | 484.7 | 0 | 0 |
| CE18 | 18 | 82 | 0.028 | 205 | 421 | 6001 | 0.07 | X | 548.0 | 477.2 | 0.1 | 0 |

* IE: Inventive Example
** CE: Comparative Example

Comparative Example 1 shows the case in which the content of carbon (C) proposed in the present disclosure was exceeded. It can be confirmed that the tensile strength after normalizing as significantly high at 625.3 MPa, due to an excessive pearlite fraction, and in addition, it can be confirmed that the degree of center segregation is increased due to the high content of carbon, resulting in deteriorating the HIC characteristics.

Comparative Examples 2 and 3 show the case that the content range of manganese (Mn) and sulfur (S) exceeds, respectively, it can be confirmed that the ferrite/pearlite fraction, (Nb, V) (C, N) precipitates, and the like are all satisfy the standard condition, but HIC characteristics may be deteriorated due to the formation of MnS elongation inclusions in the center of the steel plate.

In the case of Comparative Example 4, all of the processing conditions of the Ca treatment and the clean bubbling process, the hot rolling and the heat treatment were satisfied, but the contents of Nb and V did not fall within the range presented in the present disclosure, and (Nb, V) (C, N) precipitate fraction was low, and the tensile strength value after PWHT was as low as 482.4 MPa.

Comparative Examples 5 and 6 show the case in which the amount of Ca addition was less than the range presented in the present disclosure. In Comparative Examples 5 and 6, it can be confirmed that cleanliness of steel, that is, the total content of oxygen was controlled to be low but the HIC characteristics may be deteriorated due to the excess of central segregation defects due to MnS coarsening.

Comparative Example 7 shows the case in which the blowing amount of bubbling gas was less than the range presented in the present disclosure. In Comparative Example 7, it can be confirmed that a large amount of coarse Ca—Al—O complex inclusions were formed such that S1/S2 excesses 0.1 and the HIC characteristics may be deteriorated.

Comparative Example 8 shows a case in which the blowing amount of bubbling gas exceeds the range presented in the present disclosure. In Comparative Example 8, it can be confirmed that a large amount of coarse Ca—Al—O complex inclusions are formed due to the reoxidation due to naked molten metal in the bubbling process, such that S1/S2 exceeded 0.1 and the HIC characteristics may be deteriorated.

Comparative Examples 9 and 10 show the case that the addition rate of Metal Ca wire was lower than the range presented in the present disclosure. In Comparative Examples 9 and 10, it can be confirmed that HIC characteristics may be deteriorated.

Comparative Examples 11 and 12 show the case in which the bubbling time does not meet the range presented in the present disclosure, and the process proceeded for a very short time. In Comparative Examples 11 and 12, it can be confirmed that floatation separation time of the inclusions is insufficient such that the HIC characteristics may be deteriorated.

Comparative Examples 13 and 14 show the case in which the rolling end temperature was controlled to be very low in the subsequent finish hot rolling as the thickness of bar was not rolled to a sufficiently small thickness during size rolling and the rolling is terminated at a high temperature. In Comparative Examples 13 and 14, it can be confirmed that cleanliness of steel was secured but the HIC characteristics may be deteriorated due to fracture of the oxide inclusions due to rolling at two phase regions.

Comparative Examples 15 and 16 show the case in which size rolling satisfied the conditions presented in the present disclosure, but the rolling end temperature in the finish hot rolling was controlled to be very low. In Comparative Examples 15 and 16, it can be confirmed that the HIC characteristics may be deteriorated.

Comparative Examples 17 and 18 show the case in which the normalizing heat treatment time exceeded the range presented in the present disclosure. In Comparative Examples 17 and 18, it can be confirmed that the size of carbonitride is coarsened in a long-time heat treatment section and the strength after PWHT was very low.

On the other hand, in the case of Inventive Examples 1 to 6 satisfying both the alloy composition and the manufacturing conditions proposed in the present disclosure, as the microstructure fraction and the carbonitride after PWHT are sufficiently formed, the tensile strength value before and after PWHT was 550 to 670 MPa, and as the surface condition was good and the high cleanliness of the steel was secured, the hydrogen induced cracking characteristics were excellent.

Figure 2:
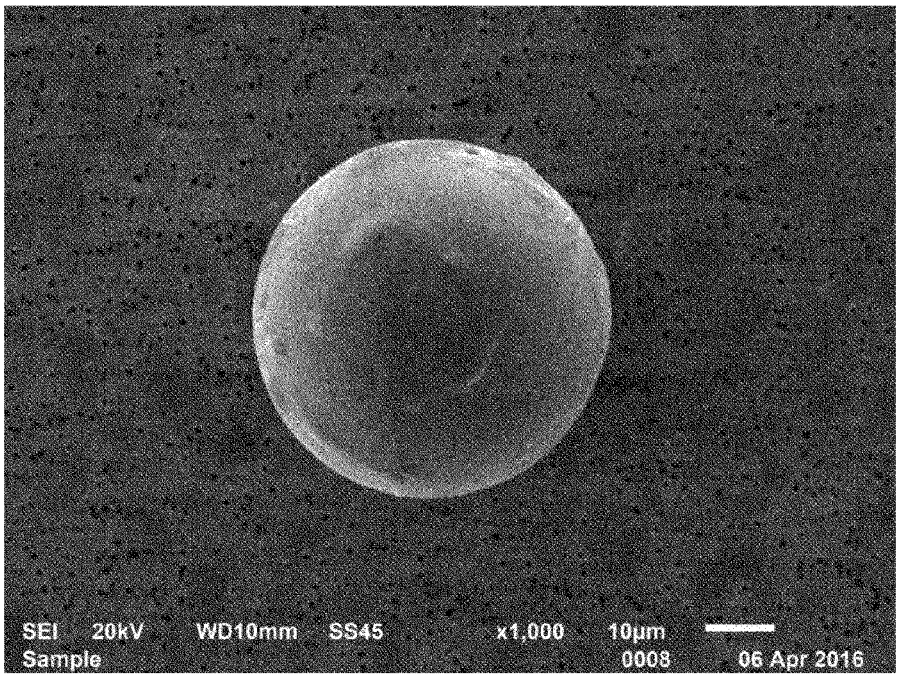
FIG. 2 is a photograph of a Ca—Al—O complex inclusion of Comparative Example 11 captured by scanning electron microscope.
Figure 3:
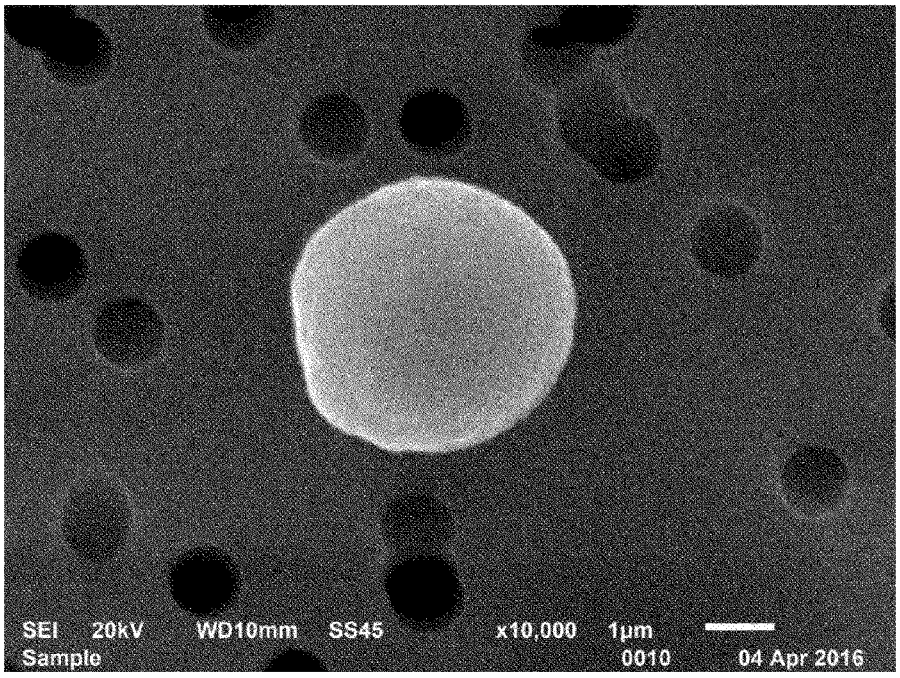
FIG. 3 is a photograph of a Ca—Al—O complex inclusion of Inventive Example 1 captured by scanning electron microscope.

FIGS. 1 and 2 are photographs taken by a scanning electron microscope after electrolytic extraction of inclusions of Comparative Example 11 and Inventive Example 1, respectively.

Comparative Example 11 shows that the case in which the bubbling time did not meet the range presented in the present disclosure and proceeded for a very short time. In Comparative Example 11, it can be confirmed that a coarse oxide inclusion having a diameter of 52.5 μm was present in the steel due to insufficient floating separation time. Meanwhile, in the case of Inventive Example 1, it can be confirmed that the alloy composition and the manufacturing conditions presented in the present disclosure were all satisfied such that the diameter of inclusions was controlled to be very small, which is 4.3 μm.

While example embodiments have been shown and described above, it will be apparent to those skilled in the art that modifications and variations could be made without departing from the scope of the present inventive concept as defined by the appended claims.

The invention claimed is:

1. A steel for pressure vessels, comprising, by wt %:

carbon (C): 0.06 to 0.25%, silicon (Si): 0.05 to 0.50%, manganese (Mn): 1.0 to 2.0%, aluminum (Al): 0.005 to 0.40%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.05 to 0.15%, copper (Cu): 0.01 to 0.50%, nickel (Ni): 0.05 to 0.50%, calcium (Ca): 0.0005 to 0.0040%, oxygen (O): 0.0010% or less, and the balance of iron (Fe) and inevitable impurities, wherein a microstructure comprises 30% or less of pearlite and 70% or more of ferrite by area fraction, wherein a Ca—Al—O complex inclusion is included to satisfy Relational Expression 1 below, $$0.02 \leq S1/S2 \leq 0.1 \quad \text{Relational Expression 1:}$$

where S1 is a total area of Ca—Al—O complex inclusions having a size of 6 μm or more, measured by a circle equivalent diameter, and S2 is a total area of all Ca—Al—O complex inclusions, wherein the Ca—Al—O complex inclusion is not fractured, and wherein the steel comprises (Nb, V) (C, N) precipitates in an amount of 0.01 to 0.02% by area after a post weld heat treatment (PWHT), and an average size of the (Nb, V) (C, N) precipitates is 5 to 30 nm.

2. The steel for pressure vessels of claim 1, wherein the steel further comprises N: 20 to 60 ppm by weight.

3. The steel for pressure vessels of claim 1, wherein the steel has tensile strength of 485 MPa or more after the post weld heat treatment (PWHT).

4. The steel for pressure vessels of claim 1, wherein the steel has a CLR of 10% or less after the post weld heat treatment (PWHT).

5. A manufacturing method of the steel for pressure vessels of claim 1, the method comprises, preparing a slab comprising, by wt %, carbon (C): 0.06 to 0.25%, silicon (Si): 0.05 to 0.50%, manganese (Mn): 1.0 to 2.0%, aluminum (Al): 0.005 to 0.40%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.05 to 0.15%, copper (Cu): 0.01 to 0.50%, nickel (Ni): 0.05 to 0.50%, calcium (Ca): 0.0005 to 0.0040%, oxygen (O): 0.0010% or less, and a balance of iron (Fe) and inevitable impurities;

heating the slab to 1150 to 1300° C.;

size rolling the heated slab to a temperature in a range of 950 to 1200° C. and then cooling to obtain a bar having a thickness of 80 to 180 mm;

heating the bar to 1150 to 1200° C.;

finish hot rolling the heated bar to a temperature in a range of (Ar3+30° C.) to (Ar3+300° C.)

and then cooling to obtain a hot-rolled steel plate having a thickness of 5 to 65 mm; and performing a normalizing heat treatment, heating the hot-rolled steel plate to 850 to 950° C., maintaining for 10 to 60 minutes, and air cooling to room temperature.

6. The manufacturing method of the steel for pressure vessels of claim 5, wherein the slab further comprises N: 20 to 60 ppm by weight %.

7. The manufacturing method of the steel for pressure vessels of claim 5, wherein the preparing the slab comprises, adding Metal Ca Wire to molten steel after secondary refining such that an amount of Ca addition is 0.00005 to 0.00050 kg/ton at an addition rate of 100 to 250 m/min; and a clean bubbling of blowing an inert gas into the molten steel into the Metal Ca Wire is added at a blowing amount of 10 to 50V min for 5 to 20 minutes.

8. The manufacturing method of the steel for pressure vessels of claim 7, wherein the Metal Ca Wire is composed of a Ca alloy and a steel material surrounding the Ca alloy, and the thickness of the steel material is 1.2 to 1.4 mm.

9. The manufacturing method of the steel for pressure vessels of claim 7, wherein blowing of the inert gas is performed through an inert gas blowing point in a ladle.

10. The manufacturing method of the steel for pressure vessels of claim 5, wherein a grain size of austenite of the bar after the size rolling is 100 μm or more.

11. The manufacturing method of the steel for pressure vessels of claim 5, wherein the step of cooling the hot-rolled steel plate to room temperature is performed by multi-stage loading until the steel plate is cooled from the temperature of 200° C. or higher to room temperature.

* * * * *